US010377956B2

(12) United States Patent
Gomez et al.

(10) Patent No.: US 10,377,956 B2
(45) **Date of Patent: *Aug. 13, 2019**

(54) PROCESS FOR HYDRODESULPHURIZING AN OLEFINIC GASOLINE

(71) Applicant: IFP Energies nouvelles, Rueil-Malmaison (FR)

(72) Inventors: Adrien Gomez, Lyons (FR); Philibert Leflaive, Mions (FR); Clementina Lopez Garcia, Irigny (FR); Annick Pucci, Croissy sur Seine (FR); Marie Godard-Pithon, Rueil Malmaison (FR); Jean-Luc Nocca, Rueil Malmaison (FR); Guobing Zhang, Beijing (CN)

(73) Assignee: IFP Energies nouvelles, Rueil-Malmaison (FR)

( * ) Notice: Subject to any disclaimer, the term of this patent is extended or adjusted under 35 U.S.C. 154(b) by 0 days.

This patent is subject to a terminal disclaimer.

(21) Appl. No.: 15/788,249

(22) Filed: Oct. 19, 2017

(65) Prior Publication Data

US 2018/0105756 A1 Apr. 19, 2018

(30) Foreign Application Priority Data

Oct. 19, 2016 (FR) ..... 16 60159

(51) Int. Cl.
*C10G 45/02* (2006.01)
*C10G 65/16* (2006.01)
(Continued)

(52) U.S. Cl.
CPC ..... *C10G 65/16* (2013.01); *C10G 45/02* (2013.01); *C10G 45/32* (2013.01); *C10G 49/22* (2013.01);
(Continued)

(58) Field of Classification Search
None
See application file for complete search history.

(56) References Cited

U.S. PATENT DOCUMENTS 6,830,678 B2 12/2004 Didillon
6,927,314 B1 8/2005 Schultz
(Continued)

FOREIGN PATENT DOCUMENTS

EP 1138749 B1 5/2006
EP 2816094 A1 12/2014

OTHER PUBLICATIONS

Search Report FR1660159 dated Jun. 9, 2017.

*Primary Examiner* — Philip Y Louie
(74) *Attorney, Agent, or Firm* — Millen, White, Zelano and Branigan, P.C.

(57) ABSTRACT

A process for the treatment of a gasoline containing sulphur-containing compounds, olefins and diolefins:

a) fractionating the gasoline into at least:
   a light gasoline cut LCN;
   a primary intermediate gasoline cut, MCN; and
   a primary heavy gasoline cut HHCN;

b) desulphurizing the primary intermediate gasoline cut MCN alone producing an at least partially desulphurized primary intermediate gasoline cut MCN;

c) desulphurizing the primary heavy gasoline cut HHCN alone producing an at least partially desulphurized primary heavy gasoline cut HHCN;

d) sending, as a mixture, the partially desulphurized primary intermediate gasoline cut MCN and the partially desulphurized primary heavy gasoline cut HHCN to a separation column separating a gaseous stream containing hydrogen and $H_2S$, a secondary intermediate gasoline cut MCN with low sulphur and mercaptans contents and a
(Continued)

secondary heavy gasoline cut HHCN containing sulphur-containing compounds including recombinant mercaptans;

e) desulphurizing the secondary heavy gasoline cut HHCN obtained from step d).

14 Claims, 2 Drawing Sheets

(51) Int. Cl.

| | |
|---|---|
| ***C10G 65/00*** | (2006.01) |
| ***C10L 1/06*** | (2006.01) |
| ***C10G 45/32*** | (2006.01) |
| ***C10G 49/22*** | (2006.01) |
| ***C10G 65/02*** | (2006.01) |

(52) U.S. Cl.

CPC ..... *C10G 65/00* (2013.01); *C10G 65/02* (2013.01); *C10L 1/06* (2013.01); *C10G 2300/104* (2013.01); *C10G 2300/1044* (2013.01); *C10G 2300/1088* (2013.01); *C10G 2300/202* (2013.01); *C10G 2300/207* (2013.01); *C10G 2400/02* (2013.01); *C10L 2270/023* (2013.01); *C10L 2290/543* (2013.01); *C10L 2290/544* (2013.01)

(56) References Cited

U.S. PATENT DOCUMENTS

| | | | | |
|---|---|---|---|---|
| 2003/0116474 | A1 | 6/2003 | Towler | |
| 2004/0188327 | A1 | 9/2004 | Groten | |
| 2007/0095725 | A1* | 5/2007 | Podrebarac ..... | C10G 65/04 208/209 |
| 2007/0246399 | A1* | 10/2007 | Picard ..... | C10G 45/02 208/78 |
| 2014/0054198 | A1 | 2/2014 | Podrebarac | |
| 2014/0374315 | A1 | 12/2014 | Gornay | |

* cited by examiner

PROCESS FOR HYDRODESULPHURIZING AN OLEFINIC GASOLINE

The present invention relates to a process for reducing the quantity of sulphur-containing compounds in an olefinic type gasoline, in order to produce a gasoline that is said to be desulphurized, while at the same time limiting the octane number loss caused by hydrogenation of the olefins.

PRIOR ART

The production of gasolines complying with new environmental standards requires a substantial reduction in their sulphur content to values which generally do not exceed 50 ppm (mg/kg), and are preferably less than 10 ppm.

It is also known that converted gasolines, and more particularly those obtained from catalytic cracking, which may represent 30% to 50% of the gasoline pool, have high olefins and sulphur contents.

For this reason, almost 90% of the sulphur present in the gasolines can be attributed to gasolines obtained from catalytic cracking processes, which will henceforth be termed FCC (Fluid Catalytic Cracking) gasoline. FCC gasolines thus constitute the preferred feed for the process of the present invention.

Among the possible pathways for producing fuels with a low sulphur content, that which has become very popular consists of specifically treating the sulphur-rich gasoline bases using hydrodesulphurization processes carried out in the presence of hydrogen and a catalyst. Traditional processes desulphurize the gasolines in a non-selective manner by hydrogenating a large proportion of the monoolefins, which results in a substantial drop in the octane number and a high hydrogen consumption. The most recent processes, such as the Prime G+ process (trade mark), can be used to desulphurize olefin-rich cracked gasolines while limiting the hydrogenation of monoolefins and, as a result, the octane number drop and the high consumption of hydrogen that ensues. Examples of processes of this type are described in patent applications EP 1 077 247 and EP 1 174 485.

As described in patent applications EP 1 077 247 and EP 1 800 748, it is advantageous to carry out a step for selective hydrogenation of the feed to be treated prior to the hydrotreatment step. This first hydrogenation step essentially consists of selectively hydrogenating the diolefins, while at the same time transforming the saturated light sulphur-containing compounds by making them heavier (by increasing their molecular weight). These sulphur-containing compounds may have a boiling point which is lower than the boiling point of thiophene, such as methanethiol, ethanethiol, propanethiol and dimethylsulphide. By fractionating the gasoline obtained from the selective hydrogenation step, a light desulphurized gasoline cut (or LCN, Light Cracked Naphtha) mainly composed of monoolefins containing 5 or 6 carbon atoms is produced without a loss of octane number, which can be upgraded to the gasoline pool in order to formulate a vehicle fuel. Under specific operating conditions, this hydrogenation selectively carries out hydrogenation, at least partial or even total, of the diolefins present in the feed to be treated into monoolefinic compounds which have a better octane number. Another effect of selective hydrogenation is to prevent the gradual deactivation of the selective hydrodesulphurization catalyst and/or to avoid gradual clogging of the reactor due to the formation of polymerization gums at the surface of the catalysts or in the reactor. In fact, polyunsaturated compounds are unstable and have a tendency to form gums by polymerization.

Patent application EP 2 161 076 discloses a process for the selective hydrogenation of polyunsaturated compounds, and more particularly of diolefins, in order to carry out joint molecular weight increase of the light sulphur-containing compounds such as mercaptans or sulphides. That process employs a catalyst containing at least one metal from group VIb and at least one non-noble metal from group VIII deposited on a porous support.

Obtaining a gasoline with a very low sulphur content, typically with a content of less than 10 ppm by weight as required in Europe, also requires at least one hydrodesulphurization step, which consists of converting the organosulphur compounds into $H_2S$. However, if this step is not controlled correctly, it may cause hydrogenation of a large proportion of the monoolefins present in the gasoline, which then results in a substantial drop in the octane number of the gasoline as well as an over-consumption of hydrogen. Another problem encountered during the hydrodesulphurization step is the formation of mercaptan type compounds resulting from the addition reaction of the $H_2S$ formed in the hydrodesulphurization reactor onto the monoolefins present in the gasoline feed. The cited Mercaptans, with chemical formula R—SH, where R is an alkyl group, are also known as thiols or recombinant mercaptans and generally represent between 20% and 80% by weight of the residual sulphur in the desulphurized gasolines.

In order to limit these disadvantages, various solutions have been described in the literature to desulphurize cracked gasolines with the aid of a combination of steps for hydrodesulphurization and elimination of recombinant mercaptans by a carefully selected technique so as to avoid hydrogenation of the monoolefins present, in order to preserve the octane number (see, for example, U.S. Pat. Nos. 7,799,210, 6,960,291, 6,387,249 and US 2007/114156).

However, it appears that although these combinations using a final step for elimination of recombinant mercaptans are particularly suitable when a very low sulphur content is desired, they can prove to be very expensive when the quantity of mercaptans to be eliminated is high; in fact, this requires high adsorbent or solvent consumptions, for example.

Some of the solutions proposed in the literature for the production of gasolines with a reduced sulphur content propose the separation by distillation of full range cracked naphtha (or FRCN) obtained from cracking processes. In some patents (for example the patents EP 1 077 247 and WO 02/072738), distillation is intended to obtain 2 cuts: a light cut (LCN) and a heavy cut (HCN, or Heavy Cracked Naphtha). The FRCN gasoline may be treated upstream of the distillation, for example using a process that can allow selective hydrogenation of the diolefins of the gasoline and/or to allow the molecular weight of the light sulphur-containing compounds to be increased, in a manner such that after the distillation operation, these sulphur-containing compounds are recovered in the heavy cut, HCN. The sulphur-containing compounds of the heavy cut are then eliminated from the gasoline by various processes, for example via a catalytic hydrodesulphurization carried out with one or more reactors.

Another solution consists of carrying out catalytic hydrodesulphurization of the gasoline feed in two hydrodesulphurization steps with an intermediate step for separation of the $H_2S$ formed in the first step. A solution of this type is illustrated, for example, in patents EP 1 174 485 and U.S. Pat. No. 7,785,461.

Some patents also concern solutions combining separation into a heavy cut and a light cut and a catalytic hydrodesulphurization carried out with two reactors with separation of the $H_2S$ formed in the first step. In this case, the separation of the light cut may be carried out either upstream of the two hydrodesulphurization steps, as illustrated in the patent EP 1 354 930, only the heavy cut then being desulphurized, or between the two hydrodesulphurization steps, the first step then treating the full range gasoline obtained from a cracking process (or FRCN, Full Range Cracked Naphtha); the second step treats only the heavy cut. Examples of this latter solution have in particular been illustrated in U.S. Pat. Nos. 6,913,688 and 7,419,586.

Other solutions employ separation by distillation of the full range gasoline FRCN into more than two cuts in order to produce a gasoline with a reduced sulphur content or even with very low sulphur contents, of the order of 10 ppm by weight. In that type of process, the cuts obtained are treated separately or partially combined in order to eliminate organic sulphur from at least a portion of the cuts obtained, the aim being to obtain a desulphurized gasoline after mixing all or at least a portion of the treated cuts.

As an example, the document US2004/188327 describes a process that can be used to reduce the sulphur content of a FCC gasoline by separating the FRCN gasoline into three cuts by means of a distillation operation: a light cut, an intermediate cut and a heavy cut. The heavy cut is desulphurized and the effluent is combined with the intermediate cut, and then it is desulphurized in its entirety during a second hydrodesulphurization step. It is specified that the mercaptans contained in the light cut may be eliminated either by thioetherification upstream of the separation into three cuts, or by a caustic downstream treatment.

The patent U.S. Pat. No. 6,103,105 describes a similar process, the FRCN (Full Range Cracked Naphtha) gasoline also being separated into three cuts by means of a distillation operation. It is specified that the light cut represents between 50% and 80% of the gasoline and that the heavy cut represents 5% to 20% of the FRCN gasoline. It is also specified that the intermediate cut and the heavy cut are hydrodesulphurized in a single reactor containing two catalytic beds. The heavy cut is treated in the first catalytic bed and the intermediate cut is added between the two beds so as to carry out a co-treatment with the partially desulphurized heavy cut obtained from the first bed in the second catalytic bed. The authors indicate that elimination of the sulphur is almost complete and also that hydrogenation of the olefins of the heavy cut is almost complete.

The patent FR 2 807 061 also describes a process for the desulphurization of gasoline, comprising a selective hydrogenation step followed by separation into at least three fractions. The lightest fraction is practically free of sulphur. The heaviest fraction is treated at least once in order to desulphurize the unsaturated sulphur-containing compounds of the cut. The intermediate fraction is characterized by an olefins and aromatics content which is relatively low. Part or all of that cut undergoes at least one desulphurization and denitrogenation step followed by a catalytic reforming step.

The patent U.S. Pat. No. 9,260,672 describes a process for the production of gasoline with a small loss of octane number. According to the inventors, after saturation of the diolefins, the FRCN gasoline is separated by distillation into a light cut with an end point of 70° C., an intermediate cut (70-90° C.) and a heavy cut (90-210° C.). The mercaptans of the light cut are eliminated with a caustic treatment in equipment known as CFC equipment (for Continuous Film Contactor). The heavy cut, containing principally thiophene type sulphur-containing compounds, is desulphurized by a catalytic hydrodesulphurization or reactive adsorption process. The intermediate cut may be sent to an isomerization unit or catalytic reforming unit. Optionally, the intermediate cut may be co-treated with the light cut in CFC equipment in order to reduce the mercaptans content, or in fact this cut may be co-treated with the heavy cut. That process does not propose a separate desulphurization treatment for the intermediate cut.

The patent application US 2004/0195151 discloses a process for the selective desulphurization of FRCN gasoline. The FRCN gasoline is introduced into a reactive distillation column in order to both carry out a thioetherification treatment of the mercaptans contained in the feed and a separation into a light cut, an intermediate cut and a heavy cut. The intermediate cut is withdrawn as a side stream and is treated in a desulphurization reactor.

The patent application US 2014/054198 describes a process for reducing the sulphur content of a stream of hydrocarbons, the process comprising bringing a FRCN gasoline into contact with a hydrogenation catalyst in order to hydrogenate at least a portion of the dienes and convert at least a portion of the mercaptans into thioethers. This FRCN gasoline is then fractionated into a light fraction, an intermediate fraction and a heavy fraction. The heavy fraction is desulphurized in a catalytic hydrodesulphurization process. The intermediate fraction is mixed with hydrogen and a gas oil cut in order to form a mixture which is brought into contact with a catalyst in a hydrodesulphurization reactor then separated in order to obtain the desulphurized intermediate fraction and to recover the gas oil cut which is recycled to the process and optionally purged.

One aim of the present invention is to propose a process for the desulphurization of an olefinic gasoline which is capable of producing, by limiting the loss of octane number, a gasoline with a low total sulphur content, typically less than 30 ppm, or more preferably less than 15 ppm or even less than 10 ppm by weight and with a very low (recombinant) mercaptans content.

SUMMARY OF THE INVENTION

The present invention concerns a process for the treatment of a gasoline containing sulphur-containing compounds, olefins and diolefins, comprising the following steps:

a) fractionating the gasoline into at least:
   a light gasoline cut LCN;
   a primary intermediate gasoline cut, MCN; and
   a primary heavy gasoline cut HHCN;
b) desulphurizing the primary intermediate gasoline cut MCN alone and in the presence of a hydrodesulphurization catalyst and hydrogen, at a temperature in the range 160° C. to 450° C., at a pressure in the range 0.5 to 8 MPa, with a liquid space velocity in the range 0.5 to 20 $h^{-1}$ and with a ratio between the flow rate of hydrogen, expressed in normal $m^3$ per hour, and the flow rate of feed to be treated, expressed in $m^3$ per hour under standard conditions, in the range 50 $Nm^3/m^3$ to 1000 $Nm^3/m^3$ in a manner such as to produce an at least partially desulphurized intermediate gasoline cut MCN;
c) desulphurizing the primary heavy gasoline cut HHCN alone in the presence of a hydrodesulphurization catalyst and hydrogen, at a temperature in the range 200° C. to 450° C., at a pressure in the range 0.5 to 8 MPa, with a liquid space velocity in the range 0.5 to 20 $h^{-1}$ and with a ratio between the flow rate of hydrogen, expressed in normal $m^3$ per hour, and the flow rate of feed to be treated, expressed in $m^3$ per hour under standard conditions, in the range 50 $Nm^3/m^3$ to 1000 $Nm^3/m^3$ in a manner such as to produce an at least partially desulphurized primary heavy gasoline cut HHCN;

d) sending, as a mixture, the partially desulphurized primary intermediate gasoline cut MCN which has not undergone treatment following step b) and the partially desulphurized primary heavy gasoline cut HHCN which has not undergone treatment following step c) to a separation column in order to separate a gaseous stream containing hydrogen and $H_2S$, a secondary intermediate gasoline cut MCN with low sulphur and mercaptans contents and a secondary heavy gasoline cut HHCN containing sulphur-containing compounds including recombinant mercaptans;

e) desulphurizing the secondary heavy gasoline cut HHCN obtained from step d) containing sulphur-containing compounds including recombinant mercaptans in the presence of a hydrodesulphurization catalyst and hydrogen, at a temperature in the range 200° C. to 450° C., at a pressure in the range 0.5 to 8 MPa, with a liquid space velocity in the range 0.5 to 20 $h^{-1}$ and with a ratio between the flow rate of hydrogen, expressed in normal $m^3$ per hour, and the flow rate of feed to be treated, expressed in $m^3$ per hour under standard conditions, in the range 50 $Nm^3/m^3$ to 1000 $Nm^3/m^3$.

The process in accordance with the invention solves the problem of desulphurizing an olefinic gasoline while limiting hydrogenation of the olefins and by reducing the recombinant mercaptans content in the desulphurized effluents because of the combination of steps mentioned above. Thus, step a) is operated in a manner such as to separate a light gasoline cut with a high octane number and a reduced sulphur-containing compounds content without having to involve a catalytic hydrodesulphurization reaction which would bring about a hydrogenation of a portion of the olefins. Step a) can also be used to separate two other complementary primary gasoline cuts MCN and HHCN which are respectively treated in steps b) and c). The hydrodesulphurization treatment (HDS) separately on each of the cuts can allow the operating conditions to be adapted as a function of the cut to be treated in order to convert the sulphur-containing compounds while controlling the olefins hydrogenation reaction. In general, the primary intermediate gasoline cut MCN contains more olefinic compounds of interest compared with the primary heavy gasoline cut HHCN. In contrast, the primary intermediate gasoline cut MCN contains fewer sulphur-containing compounds which are refractory to hydrodesulphurization than the primary heavy gasoline cut HHCN. During the step b) for hydrodesulphurization of the primary intermediate gasoline cut MCN, mercaptans termed "recombinant" mercaptans are formed by reaction of the olefins of the primary intermediate gasoline cut MCN with the $H_2S$ generated by the catalytic reaction and are responsible for the presence of sulphur in the effluent obtained from step b). In order to respond to the aim of reducing the recombinant mercaptans content, the process in accordance with the invention uses a step d) which consists of sending the hydrotreated primary intermediate MCN and heavy HHCN gasoline cuts directly to a separation column which is configured and operated in a manner such as to separate the secondary intermediate gasoline cut MCN with a low sulphur and recombinant mercaptans content. This step d) can also be used to concentrate, in a secondary heavy gasoline cut HHCN, the recombinant mercaptans initially present in the partially desulphurized primary intermediate gasoline cut MCN; the recombinant mercaptans have the characteristic of having higher boiling points than those of the olefins from which they are obtained (rendering them heavier). Finally, the process in accordance with the invention uses a step e) for desulphurization of the secondary heavy gasoline cut HHCN which contains the recombinant mercaptans, which may be operated under more severe conditions in order to intensely treat said secondary heavy gasoline cut HHCN in order, in particular, to convert the recombinant mercaptans and provide an effluent with a low sulphur content.

It should be noted that the process in accordance with the invention dispenses with steps for eliminating the $H_2S$ produced on the effluent from step c), but uses the separation column of step d). Thus, the process in accordance with the invention is advantageous in terms of investment.

In one embodiment, the separation column of step d) is configured to separate the gaseous stream from the head of the column, the secondary intermediate gasoline cut MCN with low sulphur contents and mercaptans contents via an intermediate side stream and the secondary heavy gasoline cut HHCN containing sulphur-containing compounds including recombinant mercaptans from the bottom of the column.

Alternatively, the separation column of step d) is configured to separate a mixture containing hydrogen, $H_2S$ and the secondary intermediate gasoline cut MCN from the head of the column and the secondary heavy gasoline cut HHCN containing sulphur-containing compounds including recombinant mercaptans from the bottom of the column. The mixture withdrawn from the head of the column is cooled and sent to a separation unit in order to separate the gaseous stream containing hydrogen and $H_2S$ and the secondary intermediate gasoline cut MCN with low sulphur and mercaptans contents.

In accordance with one embodiment, the secondary intermediate gasoline cut MCN obtained from step d) and the desulphurized secondary heavy gasoline cut HHCN obtained from step e) are sent to a communal stabilization column.

In one particular embodiment, before step a), the gasoline is treated in the presence of hydrogen and a selective hydrogenation catalyst in a manner such as to hydrogenate the diolefins and carry out a molecular weight-increasing reaction on a portion of the sulphur-containing compounds, step a) being operated at a temperature in the range 50° C. to 250° C., at a pressure in the range 1 to 5 MPa, with a liquid space velocity in the range 0.5 to 20 $h^{-1}$ and with a ratio between the flow rate of hydrogen, expressed in normal $m^3$ per hour, and the flow rate of feed to be treated, expressed in $m^3$ per hour under standard conditions, in the range 2 $Nm^3/m^3$ to 100 $Nm^3/m^3$.

In accordance with the invention, step a) may be carried out in two fractionation steps:

a1) fractionating the gasoline into a light gasoline cut LCN and an intermediate heavy gasoline cut HCN;

a2) fractionating the intermediate heavy gasoline cut HCN into at least one primary intermediate gasoline cut MCN and a primary heavy gasoline cut HHCN.

Alternatively, step a) is carried out in a single fractionation step. As an example, step a) is carried out in a divided wall distillation column.

Preferably, the primary intermediate gasoline cut MCN obtained from step b) has a temperature difference ($\Delta T$) between the 5% and 95% distilled weight points which is less than 75° C. The method used to determine the temperatures corresponding to 5% and 95% of the distilled weight is described in the document Oil Gas Sci. Technol. Vol. 54

(1999), No. 4, pp. 431-438 under the name "CSD method" (abbreviation of "Conventional Simulated Distillation").

Preferably, the difference in temperature ΔT between the 5% and 95% distilled weight points is in the range 20° C. to 65° C.

In accordance with one embodiment, the secondary intermediate gasoline cut MCN obtained from step d) has the same temperature difference ΔT between the 5% and 95% distilled weight points as that for the primary intermediate gasoline cut MCN.

In accordance with another embodiment, the secondary intermediate gasoline cut MCN obtained from step d) has a temperature difference ΔT between the 5% and 95% distilled weight points which is less than that for the primary intermediate gasoline cut MCN, it being understood that said temperature difference ΔT between the 5% and 95% distilled weight points is less than 75° C.

Preferably, the hydrodesulphurization catalysts of steps b) and c) comprise at least one element from group VIII, at least one element from group VIb and a support.

The process of the invention is adapted to the treatment of a gasoline cut obtained from a catalytic cracking or thermal unit.

BRIEF DESCRIPTION OF THE DRAWINGS

Other characteristics and advantages of the invention will become apparent from reading the following description, given solely by way of non-limiting illustration and made with reference to the following figures.

DESCRIPTION OF THE FEED

Figure 1:
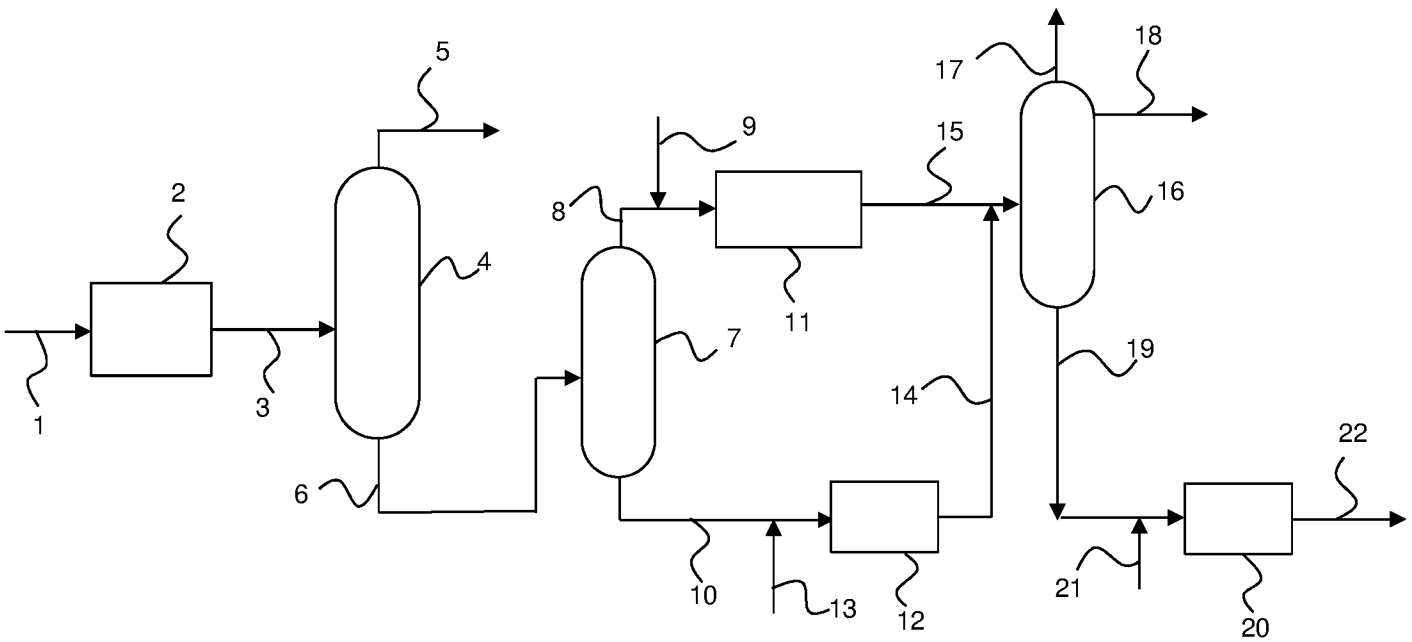
FIG. 1 is a first flow diagram for the process in accordance with the invention.

The process in accordance with the invention can be used to treat any type of olefinic gasoline cut containing sulphur, for which the boiling point range typically extends from approximately the boiling points of hydrocarbons containing 2 or 3 carbon atoms ($C_2$ or $C_3$) to approximately 250° C., preferably from approximately the boiling points of hydrocarbons containing 2 or 3 carbon atoms ($C_2$ or $C_3$) to approximately 220° C., more preferably from approximately the boiling points of hydrocarbons containing 4 carbon atoms to approximately 220° C. The process in accordance with the invention may also be used to treat feeds with end points below those mentioned above such as, for example, a C5-200° C. or C5-160° C. cut.

The process in accordance with the invention may preferably be used to treat a gasoline cut obtained from a catalytic cracking or thermal cracking unit such as, for example, a delayed coker or a visbreaking unit. A feed obtained by mixing cuts obtained from these various origins is also possible. In particular, the gasoline cut from the process in accordance with the invention may be obtained from a catalytic cracking unit the feed for which has been pre-treated or which functions in a manner such as to increase or even maximize the propylene yield. In this latter case, the mode of operation of the catalytic cracking unit is typically characterized by severe operating conditions (high temperature and with a high ratio of catalyst to feed), by using a catalyst comprising a zeolite with form selectivity (for example with a MFI crystalline structure), with a recycle of a portion of the gasoline cut produced or an oligomerate of the C4 cut in the catalytic cracking unit, this recycled stream possibly being treated either at the same time as the feed (known as coprocessing) or in a dedicated reactor in order to uncouple the conditions for cracking the heavy feed and those for the recycled stream (known as a two-riser process).

The sulphur content of gasoline cuts produced by catalytic cracking (FCC) or non-catalytic cracking depends on the sulphur content of the treated feed, on the presence or absence of pre-treatment of the feed, and also on the end point of the cut. In general, the sulphur contents of the gasoline cut as a whole, in particular those from FCC, are more than 100 ppm by weight and the majority of the time more than 500 ppm by weight. For gasolines with end points of more than 200° C., the sulphur contents are often more than 1000 ppm by weight, and may even in some cases reach values of the order of 4000 to 5000 ppm by weight.

As an example, the gasolines obtained from catalytic cracking units (FCC) contain, on average, between 0.5% and 5% by weight of diolefins, between 20% and 50% by weight of olefins, and between 10 ppm and 0.5% by weight of sulphur, generally including less than 300 ppm of mercaptans. The mercaptans are generally concentrated in the light fractions of the gasoline and more precisely in the fraction with a boiling point of less than 120° C.

The sulphur-containing species contained in the feeds treated by the process of the invention may be mercaptans or heterocyclic compounds such as, for example, thiophenes or alkylthiophenes, or heavier compounds such as benzothiophene, for example. In contrast to mercaptans, these heterocyclic compounds cannot be eliminated by extractive processes. These sulphur-containing compounds are consequently eliminated by a hydrotreatment which results in their transformation into hydrocarbons and $H_2S$.

Referring now to FIG. 1, which represents a particular embodiment of the invention, an olefinic gasoline feed, for example a catalytically cracked gasoline described above, is treated in an optional step which carries out the selective hydrogenation of the diolefins and the conversion (molecular weight increase) of a portion of the mercaptan compounds (RSH) present in the feed into thioethers, by reaction with olefins. Typically, the mercaptans which may react during the optional selective hydrogenation step are the following (non-exhaustive list): methyl mercaptan, ethyl mercaptan, n-propyl mercaptan, iso-propyl mercaptan, iso-butyl mercaptan, tert-butyl mercaptan, n-butyl mercaptan, sec-butyl mercaptan, iso-amyl mercaptan, n-amyl mercaptan, α-methylbutyl mercaptan, α-ethylpropyl mercaptan, n-hexyl mercaptan, and 2-mercapto-hexane. To this end, the FRCN gasoline feed is sent, via the line 1, to a selective hydrogenation catalytic reactor 2 containing at least one fixed or moving bed of catalyst for the selective hydrogenation of diolefins and for increasing the molecular weight of the mercaptans. The reaction for the selective hydrogenation of diolefins and for increasing the molecular weight of the mercaptans is preferably carried out on a sulphurized catalyst comprising at least one element from group VIII (groups 8, 9 and 10 of the new periodic classification, Handbook of Chemistry and Physics, 76th edition, 1995-1996) and optionally at least one element from group VIb (group 6 of the new periodic classification, Handbook of Chemistry and Physics, 76th edition, 1995-1996) and a support. The element from group VIII is preferably selected from nickel and cobalt, and in particular nickel. The element from group VIb, when it is present, is preferably selected from molybdenum and tungsten; highly preferably, it is molybdenum.

The catalyst support is preferably selected from alumina, nickel aluminate, silica, silicon carbide or a mixture of these oxides. Preferably, alumina is used, and more preferably, high purity alumina. In accordance with a preferred embodiment, the selective hydrogenation catalyst contains nickel in a content by weight of nickel oxide (in the form of NiO) in the range 4% to 12%, and molybdenum in an amount, as the amount by weight of molybdenum oxide (in the form of $MoO_3$), in the range 6% to 18%, and a nickel/molybdenum molar ratio in the range 1 to 2.5, the metals being deposited on a support constituted by alumina and wherein the degree of sulphurization of the metals constituting the catalyst is more than 80%.

During the optional selective hydrogenation step, the gasoline is brought into contact with the catalyst at a temperature in the range 50° C. to 250° C., and preferably in the range 80° C. to 220° C., and yet more preferably in the range 90° C. to 200° C., with a liquid space velocity (LHSV) in the range 0.5 $h^{-1}$ to 20 $h^{-1}$, the unit for the liquid space velocity being a liter of feed per liter of catalyst and per hour (L/L·h). The pressure is in the range 0.4 MPa to 5 MPa, preferably in the range 0.6 to 4 MPa and yet more preferably in the range 1 to 2 MPa. The optional selective hydrogenation step is typically carried out with a $H_2$/gasoline feed ratio in the range 2 to 100 $Nm^3$ of hydrogen per $m^3$ of feed, preferably in the range 3 to 30 $Nm^3$ of hydrogen per $m^3$ of feed.

The entirety of the feed is generally injected into the inlet to the reactor. However, it may in some cases be advantageous to inject a fraction or all of the feed between two consecutive catalytic beds placed in the reactor. This embodiment means that, in particular, the reactor can continue to be operated if the inlet to the reactor becomes blocked by deposits of polymers, particles or gums present in the feed.

As indicated in FIG. 1, the effluent withdrawn from the reactor 2 via the line 3 is treated in accordance with step a) of the process at the end of which three cuts, light gasoline LCN, primary intermediate MCN and primary heavy HHCN, are recovered. In the embodiment of FIG. 1, this step a) comprises two sub-steps a1) and a2). The effluent 3 is sent to a fractionation column 4 (or splitter) configured to separate the gasoline into two cuts: a light gasoline cut LCN 5 (or light gasoline) and a (first) heavy gasoline cut HCN 6, which is constituted by the heavy fraction complementary to the light gasoline LCN (step a1). The final boiling point of the light cut is selected in a manner such as to provide a light gasoline cut LCN with a low sulphur content (total sulphur content typically less than 30 ppm by weight and preferably less than 10 ppm by weight) without the need for a subsequent hydrodesulphurization. Thus, preferably, the light gasoline cut LCN is a $C_5^-$ hydrocarbon cut (i.e. containing hydrocarbons containing 5 and fewer than 5 carbon atoms per molecule). The (first) heavy gasoline cut HCN, which is preferably a $C_6^+$ cut (i.e. containing hydrocarbons which may contain 6 and more than 6 carbon atoms per molecule), is sent to the step a2) which can fractionate said (first) heavy gasoline cut HCN into two complementary gasoline cuts, a primary intermediate gasoline cut MCN and a primary heavy gasoline cut HHCN.

Step a) in accordance with the invention is preferably carried out in a manner such as to produce a primary intermediate gasoline cut MCN wherein the temperature difference (ΔT) between the temperatures corresponding to 5% and to 95% of the distilled weight is less than or equal to 75° C., preferably in the range 20° C. to 65° C. The temperature corresponding to 5% of the distilled weight of the primary intermediate gasoline cut MCN is preferably in the range 50° C. to 70° C. and the temperature corresponding to 95% of the distilled weight of the primary intermediate gasoline cut MCN is preferably in the range 80° C. to 125° C. As an example, the primary intermediate gasoline cut MCN has a temperature corresponding to 5% of the distilled weight which is equal to 65° C.±2° C., or equal to 60° C.±2° C. or equal to 55° C.±2° C. Preferably, the primary intermediate gasoline cut MCN has a temperature corresponding to 95% of the distilled weight which is equal to 120° C.±2° C., or even equal to 115° C.±2° C. The method used to determine the temperatures corresponding to 5% and 95% of the distilled weight has been described in the document Oil Gas Sci. Technol. Vol. 54 (1999), No. 4, pp. 431-438 under the title "CSD method" (abbreviation for "Conventional Simulated Distillation").

In a preferred embodiment, the primary intermediate gasoline cut MCN essentially contains hydrocarbons containing 6 or 7 carbon atoms, and mainly hydrocarbons containing 6 carbon atoms.

Referring to FIG. 1, the (first) heavy gasoline cut HCN is sent to a fractionation column 7 configured to separate a primary intermediate gasoline cut MCN overheat which is withdrawn via the line 8 and from the bottom, a primary heavy gasoline cut HHCN is withdrawn via the line 10 (step a2).

In accordance with step b) of the process, the primary intermediate gasoline cut MCN 8, is treated by hydrodesulphurization. The primary intermediate gasoline cut MCN is thus brought into contact with hydrogen supplied via the line 9 and a selective HDS catalyst in at least one hydrodesulphurization unit 11 which comprises at least one reactor with a fixed or moving bed of catalyst. The hydrodesulphurization reaction is generally carried out at a temperature in the range 160° C. to 450° C., at a pressure in the range 0.5 to 8 MPa. The liquid space velocity is generally in the range 0.5 to 20 $h^{-1}$ (expressed as the volume of liquid per volume of catalyst and per hour), preferably in the range 1 to 8 $h^{-1}$. The ratio of the $H_2$/primary intermediate gasoline cut MCN is adjusted as a function of the desired degrees of hydrodesulphurization to be in the range 50 to 1000 normal $m^3$ per $m^3$ under standard conditions. Preferably, the mixture of the primary intermediate gasoline cut MCN with the hydrogen brought into contact with the catalyst in step b) is entirely in the vapour phase. Preferably, the temperature is in the range 200° C. to 400° C., and more preferably in the range 200° C. to 350° C. Preferably, the pressure is in the range 1 to 3 MPa.

The selective HDS catalyst, employed in the sulphurized form, comprises at least one element from group VIII (groups 8, 9 and 10 of the new periodic classification, Handbook of Chemistry and Physics, 76th edition, 1995-1996), at least one element from group VIb (group 6 of the new periodic classification, Handbook of Chemistry and Physics, 76th edition, 1995-1996) and a support. The element from group VIII is preferably selected from nickel and cobalt, and in particular is cobalt. The element from group VIb is preferably selected from molybdenum and tungsten, and highly preferably is molybdenum. The catalyst may, for example, be a catalyst as described in the patents FR 2 840 315, FR 2 840 316, FR 2 904 242 or FR 3 023 184. The support for the catalyst is preferably selected from alumina, nickel aluminate, silica, silicon carbide, or a mixture of these oxides. Preferably, alumina is used.

It should be noted that the hydrogen supplied via the line 9 may be makeup hydrogen or recycle hydrogen originating from a step of the process. Preferably, the hydrogen of line 9 is makeup hydrogen.

During this step b), the reaction for the formation of recombinant mercaptans by addition of the $H_2S$ formed to the olefins also takes place. In general, the recombinant mercaptans have boiling temperatures which are higher than those of the olefins from which they are obtained. As an example, 2-methyl-2-pentene (boiling point when pure under normal conditions: 67° C.) can form a recombinant mercaptan containing 5 carbon atoms such as 2-methyl-2-pentanethiol (boiling point when pure under normal conditions: 125° C.). This property is used to separate the recombinant mercaptans from the partially desulphurized primary intermediate gasoline cut MCN in accordance with step d) of the process, as explained below. As indicated in FIG. 1, the partially desulphurized primary effluent MCN, containing recombinant mercaptans, unreacted hydrogen and $H_2S$, is extracted from the reactor 11 via the line 15. In accordance with step c) of the process, the primary heavy gasoline cut HHCN is also treated by hydrodesulphurization by contact with hydrogen supplied via the line 13 and a selective HDS catalyst in at least one hydrodesulphurization unit 12 which comprises at least one reactor with a fixed or moving bed of catalyst. The hydrodesulphurization reaction is generally carried out at a temperature in the range 200° C. to 450° C., at a pressure in the range 0.5 to 8 MPa. The liquid space velocity is generally in the range 0.5 to 20 $h^{-1}$ (expressed as the volume of liquid per volume of catalyst and per hour), preferably in the range 1 to 8 $h^{-1}$. The $H_2$/primary heavy gasoline cut HHCN ratio is adjusted as a function of the desired degrees of hydrodesulphurization to an interval in the range 50 to 1000 normal $m^3$ per $m^3$ under standard conditions. Preferably, the mixture of the primary heavy gasoline cut HHCN with hydrogen brought into contact with the catalyst in step c) is wholly in the vapour phase. Preferably, the temperature is in the range 200° C. to 400° C., and highly preferably in the range 200° C. to 350° C. Preferably, the pressure is in the range 1 to 3 MPa. The description of the catalyst of step b) is also valid for the catalyst of step c).

Given that the primary heavy gasoline cut HHCN generally contains fewer olefins than the intermediate gasoline cut but more organo-sulphur compounds which are more refractory, the hydrodesulphurization operating conditions for step c) are generally more severe than those for step b).

A partially desulphurized primary effluent HHCN containing unreacted hydrogen, $H_2S$ and possibly recombinant mercaptans, is extracted from the reactor 12 via the line 14.

In accordance with step d) of the process, the primary hydrotreated effluents MCN and HHCN obtained respectively from steps b) and c) are brought into contact then separated in a fractionation column 16. It should be noted that the hydrotreated effluents have not undergone a step for the separation of $H_2S$ before step d).

The separation step d) is operated in a manner such as to provide:

- a gaseous stream 17 containing hydrogen, $H_2S$ and optionally $C_4^-$ hydrocarbons;
- a secondary intermediate gasoline cut MCN which is desulphurized and has a low recombinant mercaptans content 18, optionally stabilized; and
- a secondary heavy gasoline cut HHCN, 19, containing recombinant mercaptans.

As discussed above, the recombinant mercaptans present in the intermediate gasoline cut generally have boiling points which are higher than those of the olefins from which they are obtained. Thus, by operating step d) carefully, the ex-MCN recombinant mercaptans are transferred to the secondary heavy gasoline cut HHCN which is separated by the fractionation column 16. The fractionation column is preferably operated in a manner such as to produce a secondary intermediate gasoline cut MCN with the temperature difference (ΔT) between the temperatures corresponding to 5% and 95% of the distilled weight being 75° C. or less, determined using the method described in the document Oil Gas Sci. Technol. Vol. 54 (1999), No. 4, pp. 431-438 under the title "CSD method", and which is equal to that for the primary intermediate gasoline cut MCN.

Alternatively, step d) may be carried out in a manner such as to recover a secondary intermediate gasoline cut MCN for which the temperature difference (ΔT) between the temperatures corresponding to 5% and to 95% of the distilled weight is 75° C. or less, determined using the method described in the document Oil Gas Sci. Technol. Vol. 54 (1999), No. 4, pp. 431-438 under the title "CSD method", and which is lower than that for the primary intermediate gasoline cut MCN. As an example, for the secondary intermediate gasoline cut MCN, the temperature corresponding to 95% of the distilled weight is 10° C. lower than the 95% distilled weight temperature for the primary intermediate gasoline cut MCN.

In accordance with another embodiment (not shown), step d) is operated in a fractionation column configured in order to separate:

- at the column head, a gaseous phase containing hydrocarbons of the secondary intermediate gasoline cut MCN, unreacted hydrogen and $H_2S$;
- the secondary heavy gasoline cut HHCN containing recombinant mercaptans which is withdrawn from the column bottom.

The gaseous phase withdrawn from the column head is then treated in order to condense the secondary intermediate gasoline cut MCN. To this end, said gaseous phase is cooled using a chiller unit and the cooled effluent is then sent to a separator drum in order to recover a gaseous stream essentially containing hydrogen and $H_2S$, optionally with $C_4^-$ hydrocarbons and a liquid hydrocarbon phase corresponding to the intermediate gasoline cut MCN which has been purified of $H_2$ and $H_2S$.

Referring to FIG. 1, the secondary heavy gasoline cut HHCN 19 recovered from the bottom of the fractionation column 16 is treated in accordance with step e) by hydrodesulphurization which in particular is intended to convert the recombinant mercaptans. To this end, said secondary heavy gasoline cut HHCN is brought into contact with hydrogen supplied via the line 21 and a selective HDS catalyst in at least one hydrodesulphurization unit 20 which comprises at least one reactor with a fixed or moving bed of catalyst. The hydrodesulphurization reaction is generally carried out at a temperature in the range 200° C. to 450° C., under a pressure in the range 0.5 to 8 MPa. The liquid space velocity is generally in the range 0.5 to 20 $h^{-1}$ (expressed as the volume of liquid per volume of catalyst and per hour), preferably in the range 1 to 8 $h^{-1}$. The $H_2$/secondary heavy gasoline cut HHCN ratio is adjusted, as a function of the desired degrees of hydrodesulphurization, to a point in the range 50 to 1000 normal $m^3$ per $m^3$ under standard conditions. Preferably, the mixture of the secondary heavy gasoline cut HHCN with hydrogen brought into contact with the catalyst in step e) is wholly in the vapour phase. Preferably, the temperature is in the range 200° C. to 400° C., and highly preferably is in the range 200° C. to 350° C. Preferably, the pressure is in the range 1 to 3 MPa. The catalyst employed in step e) preferably corresponds to the description of the catalysts for steps b) and/or c). However, the catalysts of steps b), c) and e) may have different formulations while still being encompassed by the above description.

The desulphurized secondary effluent HHCN 22 extracted from the hydrodesulphurization unit 20 is advantageously sent to a stabilization column in order to separate the hydrogen, $H_2S$ and $C_4^-$ hydrocarbon compounds. In accordance with one embodiment, the secondary intermediate gasoline cut MCN obtained from step d) is also sent to the same stabilization column.

Typically, the secondary gasoline cuts MCN and HHCN respectively obtained from steps d) and e) have total sulphur contents of less than 30 ppm by weight, preferably less than 15 ppm by weight and more preferably less than 10 ppm by weight of total sulphur. Furthermore, the mercaptans content of the secondary gasoline cuts MCN and HHCN respectively obtained from steps d) and e), expressed in sulphur equivalents, is less than 10 ppm by weight.

Figure 2:
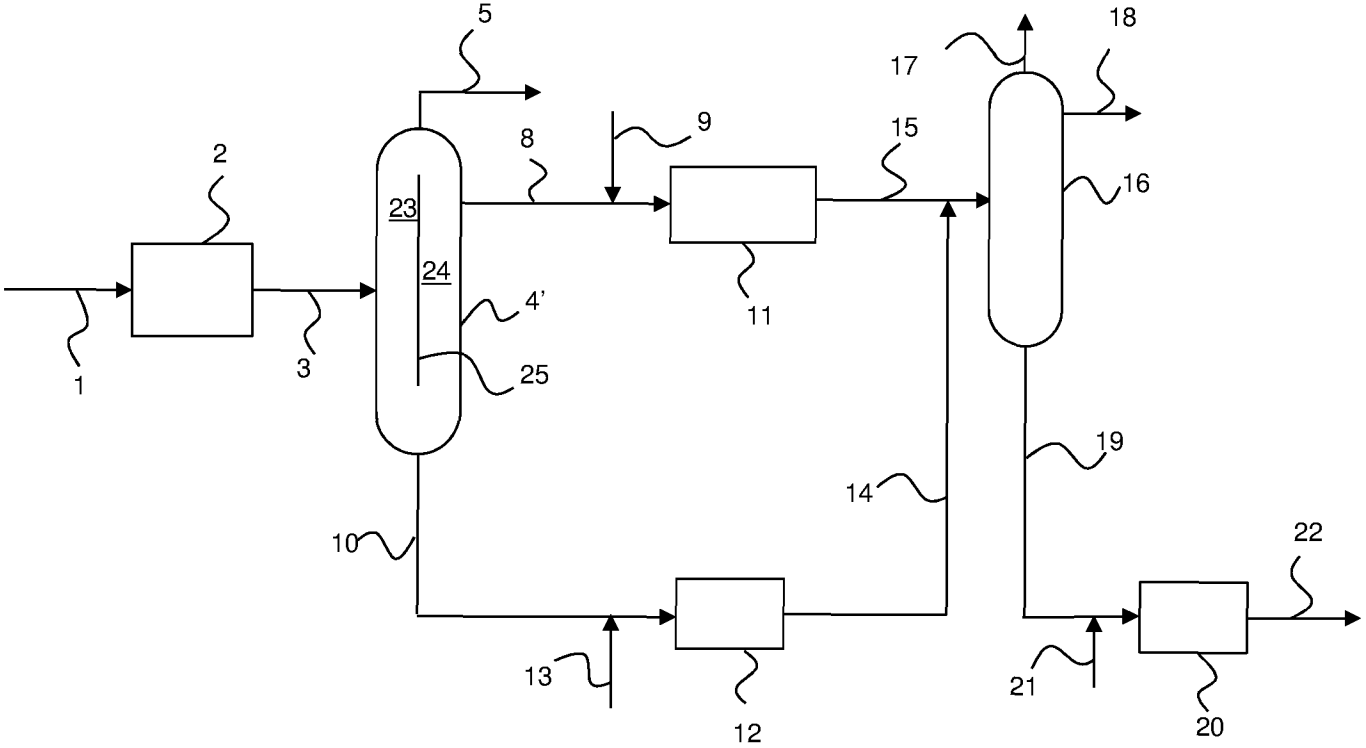
FIG. 2 is a flow diagram for a process according to another embodiment.

FIG. 2 shows another embodiment of the process in accordance with the invention, which differs from that of FIG. 1 by the fact that step a) for fractionation of the gasoline into three cuts may be carried out in a single step using a single column. Preferably, said distillation column is a divided wall column. This type of column has been described in detail in the literature, for example in the publication Chemical Engineering and Processing, 49 (2010) pp 559-580. By way of example, this type of column can be used to separate three products with different volatilities in a single fractionation column instead of using two columns in series, which provides savings as regards energy and investment costs. The documents US 2003/0116474 A1, U.S. Pat. Nos. 6,927,314 B1 and 7,947,860 B2 illustrate applications of this type of column for the fractionation of gasolines into at least 3 cuts.

The principle of a divided wall column is to install, inside a fractionation column, a vertical wall in a median vertical part of the column. This separating wall extends between the opposite sides of the interior surface of the column. A seal installed between the vertical wall and the interior surface of the column provides the divided wall with a seal in a manner such that the fluids cannot pass horizontally from one side to the other of the column. The interior vertical wall divides the central portion of the column into two parallel fractionation zones or chambers (equivalent to two splitters). Each fractionation zone may contain conventional vapour-liquid contact equipment such as plates, packings or both, depending on the design of the column.

In the embodiment of FIG. 2, the divided wall column comprises two fractionation chambers 23 and 24 separated by a vertical partition wall 25 disposed in a central section of the column which extends over both a portion of the rectifying section and over a portion of the bottom stripping section of the column. From the divided wall column 4', the light gasoline cut LCN 5 is withdrawn directly overhead from the column, the primary heavy gasoline cut HHCN 10 is withdrawn from the bottom of the column, and the primary intermediate gasoline cut MCN 8 is withdrawn as a side stream from a fractionation chamber 24.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding French application No. 16/60.159, filed Oct. 19, 2016 is incorporated by reference herein.

EXAMPLE

Table 1 presents the characteristics of a FCC gasoline treated using the process in accordance with FIG. 1 of the present invention. In this example, the results are presented without the use of a selective hydrogenation reactor 2.

A gasoline FRCN 1 was fractionated in order to obtain a light gasoline cut LCN and an intermediate heavy gasoline cut HCN 6 which was then fractionated, as proposed by the invention, into a primary intermediate gasoline cut MCN 8, and a secondary heavy gasoline HHCN 10.

The analytical methods used to characterize the feeds and effluents were as follows:

Density in accordance with the method of NF EN ISO 12185.

Sulphur content in accordance with the ASTM D2622 method for contents higher than 10 ppm S and ISO 20846 for contents lower than 10 ppm S.

Mercaptan content in accordance with the ASTM D3227 method.

Distillation in accordance with the "CSD" simulated distillation method described in the document Oil Gas Sci. Technol. Vol. 54 (1999), No. 4, pp. 431-438.

TABLE 1

Characteristics of FCC HCN, primary MCN and primary HHCN cuts of FIG. 1

| | Line 6 HCN | Line 8 Primary intermediate gasoline MCN | Line 10 Primary heavy gasoline HHCN |
|---|---|---|---|
| Density at 15° C. (g/cm$^3$) | 0.795 | 0.711 | 0.82 |
| Organic sulphur content (ppm S) | 1279 | 481 | 1543 |
| Mercaptans content (ppm S) | 13 | 23 | 10 |
| Simulated distillation | | | |
| 5% distilled weight (° C.) | 69 | 58 | 100 |
| 10% distilled weight (° C.) | 74 | 62 | 111 |
| 30% distilled weight (° C.) | 113 | 72 | 140 |
| 50% distilled weight (° C.) | 143 | 75 | 162 |
| 70% distilled weight (° C.) | 172 | 83 | 182 |

TABLE 1-continued

Characteristics of FCC HCN, primary MCN and primary HHCN cuts of FIG. 1

| | Line 6 HCN | Line 8 Primary intermediate gasoline MCN | Line 10 Primary heavy gasoline HHCN |
|---|---|---|---|
| 90% distilled weight (° C.) | 207 | 96 | 208 |
| 95% distilled weight (° C.) | 220 | 100 | 218 |
| 99.5% distilled weight (° C.) | 235 | 104 | 233 |

In accordance with the example of FIG. 1, the primary intermediate gasoline cut MCN was a cut for which the 5% distilled weight temperature was 58° C. and the 95% distilled weight temperature was 100° C. (points determined in accordance with the "CSD" simulated distillation method described in the scientific literature (Oil Gas Sci. Technol. Vol. 54 (1999), No. 4, pp. 431-438). For this primary intermediate gasoline cut MCN, the temperature difference between the 5% and 95% by weight distillation points was 42° C.

As indicated in the example of FIG. 1, the primary intermediate gasoline cut MCN was mixed with hydrogen and treated in a selective hydrodesulphurization unit (reactor 11) in the presence of a CoMo catalyst supported on alumina (HR806 marketed by Axens). The temperature was 240° C., the pressure was 2 MPa, the liquid space velocity (expressed as the volume of liquid per volume of catalyst and per hour) was 4 $h^{-1}$, the $H_2$/primary MCN cut ratio was 360 normal $m^3$ per $m^3$ under standard conditions. The characteristics of the partially desulphurized primary intermediate gasoline cut MCN are indicated in Table 2.

The primary heavy gasoline cut HHCN was mixed with hydrogen and treated in a selective hydrodesulphurization unit (reactor 12) in the presence of a CoMo catalyst supported on alumina (HR806 marketed by Axens). The temperature was 260° C., the pressure was 2 MPa, and the liquid space velocity (expressed as the volume of liquid per volume of catalyst and per hour) was 4 $h^{-1}$, the $H_2$/heavy gasoline cut HHCN ratio was 360 normal $m^3$ per $m^3$ under conditions standards. The characteristics of the partially desulphurized primary heavy gasoline cut HHCN are indicated in Table 2.

The partially desulphurized primary intermediate gasoline cut MCN (line 15) was mixed with the partially desulphurized primary heavy gasoline cut HHCN and sent to a fractionation column 16 (in accordance with step d) of the invention) for which the cut point had been fixed at 100° C.

The secondary intermediate gasoline cut MCN with a low sulphur and recombinant mercaptans content (line 18) was withdrawn from the top of the fractionation column 16. The characteristics of the secondary intermediate gasoline MCN with a low sulphur and recombinant mercaptans content (stabilized) are indicated in Table 2.

The fractionation step d) was highly advantageous in recovering the majority of the recombinant mercaptans with the secondary heavy gasoline cut HHCN withdrawn from the bottom of the fractionation column 16. This secondary heavy gasoline HHCN containing sulphur-containing compounds including recombinant mercaptans was desulphurized in this example in the presence of a selective hydrodesulphurization catalyst (reactor 20) in the presence of a CoMo catalyst supported on alumina (HR806 marketed by Axens). The temperature was 262° C., the pressure was 2 MPa, and the liquid space velocity (expressed as the volume of liquid per volume of catalyst and per hour) was 2.7 $h^{-1}$, the $H_2$/heavy HHCN cut ratio withdrawn from the bottom of the column 16 was 360 normal $m^3$ per $m^3$ under standard conditions. The characteristics of the desulphurized heavy gasoline cut HHCN (line 22) are indicated in Table 2.

TABLE 2

Characteristics of primary intermediate gasoline cut MCN, secondary intermediate gasoline cut MCN and desulphurized heavy gasoline cut HHCN of FIG. 1

| | Organic sulphur content (ppm S) | Mercaptans content (ppm S) | Bromine number (g/100 g) | Temperature at 5% of distilled weight | Temperature at 95% of distilled weight |
|---|---|---|---|---|---|
| Line 15 Partially desulphurized primary intermediate gasoline MCN | 104 | 98 | 87 | 58 | 100 |
| Line 18 Secondary intermediate gasoline MCN with low sulphur and mercaptans content | 10 | 4 | 87 | 58 | 98 |
| Line 22 Desulphurized secondary heavy gasoline HHCN | 11 | 9 | 24 | 98 | 218 |

The process in accordance with the invention can therefore be used to produce an intermediate gasoline after the steps for hydrodesulphurization (step b) and fractionation (step d) with a low total sulphur content and with a mercaptans content of less than 10 ppm by weight, expressed as the sulphur equivalent, thereby limiting the hydrogenation of olefins.

Before the hydrodesulphurization step, the primary intermediate gasoline cut MCN had a total organic sulphur content of 481 ppm by weight of sulphur, including 13 ppm by weight of sulphur from mercaptans. After the desulphurization step, the primary effluent MCN had a total organic sulphur content of 104 ppm of sulphur. The major portion of the organic sulphur was in the form of recombinant mercaptans (98 ppm sulphur).

By means of the fractionation step d), which was carried out carefully in order to keep the distillation range for the secondary intermediate cut MCN narrow, a secondary intermediate gasoline MCN was obtained which had both a low organic sulphur content (10 ppm by weight of sulphur) and a low mercaptans content (4 ppm by weight of sulphur).

The secondary intermediate gasoline cut MCN had a temperature difference ($\Delta T$) between the temperatures corresponding to 5% and to 95% of the distilled weight of 40° C., which was less than that for the primary intermediate gasoline cut MCN (42° C.).

Thus, the process in accordance with the invention can be used to satisfy two constraints, namely providing a gasoline cut with a low (recombinant) mercaptans content and with no loss of octane number.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for the treatment of a gasoline containing sulphur-containing compounds, olefins and diolefins, comprising:

a) fractionating the gasoline into at least:
   a light gasoline cut LCN;
   a primary intermediate gasoline cut, MCN; and
   a primary heavy gasoline cut HHCN;

b) desulphurizing the primary intermediate gasoline cut MCN alone and in the presence of a hydrodesulphurization catalyst and hydrogen, at a temperature of 160° C. to 450° C., at a pressure of 0.5 to 8 MPa, with a liquid space velocity of 0.5 to 20 $h^{-1}$ and with a ratio between the flow rate of hydrogen, expressed in normal $m^3$ per hour, and the flow rate of feed to be treated, expressed in $m^3$ per hour under standard conditions, of 50 $Nm^3/m^3$ to 1000 $Nm^3/m^3$ to produce an at least partially desulphurized primary intermediate gasoline cut MCN;

c) desulphurizing the primary heavy gasoline cut HHCN alone in the presence of a hydrodesulphurization catalyst and hydrogen, at a temperature of 200° C. to 450° C., at a pressure of 0.5 to 8 MPa, with a liquid space velocity of 0.5 to 20 $h^{-1}$ and with a ratio between the flow rate of hydrogen, expressed in normal $m^3$ per hour, and the flow rate of feed to be treated, expressed in $m^3$ per hour under standard conditions, of 50 $Nm^3/m^3$ to 1000 $Nm^3/m^3$ to produce an at least partially desulphurized primary heavy gasoline cut HHCN;

d) sending, as a mixture, the partially desulphurized primary intermediate gasoline cut MCN which has not undergone treatment following b) and the partially desulphurized primary heavy cut HHCN which has not undergone treatment following c) to a separation column in order to separate a gaseous stream containing hydrogen and $H_2S$, a secondary intermediate gasoline cut MCN and a secondary heavy gasoline cut HHCN containing sulphur-containing compounds including recombinant mercaptans, wherein the secondary intermediate gasoline cut MCN has a sulphur and mercaptans content less than the secondary heavy gasoline cut HHCN; and e) desulphurizing the secondary heavy gasoline cut HHCN obtained from d) containing sulphur-containing compounds including recombinant mercaptans in the presence of a hydrodesulphurization catalyst and hydrogen, at a temperature of 200° C. to 450° C., at a pressure of 0.5 to 8 MPa, with a liquid space velocity of 0.5 to 20 $h^{-1}$ and with a ratio between the flow rate of hydrogen, expressed in normal $m^3$ per hour, and the flow rate of feed to be treated, expressed in $m^3$ per hour under standard conditions, of 50 $Nm^3/m^3$ to 1000 $Nm^3/m^3$.

2. The process as claimed in claim 1, in which the separation column of d) is configured to separate the gaseous stream from the head of the column, the secondary intermediate gasoline cut MCN via an intermediate side stream and the secondary heavy gasoline cut HHCN containing sulphur-containing compounds including recombinant mercaptans from the bottom of the column.

3. The process as claimed in claim 1, in which the separation column of step d) is configured to separate a mixture containing hydrogen, $H_2S$ and the secondary intermediate gasoline cut MCN from the head of the column and the secondary heavy gasoline cut HHCN containing sulphur-containing compounds including recombinant mercaptans from the bottom of the column, and in which said mixture is cooled and sent to a separation unit in order to separate the gaseous stream containing hydrogen and $H_2S$ and the secondary intermediate gasoline cut MCN.

4. The process as claimed in claim 1, in which, before a), the gasoline is selectively hydrogenated in the presence of hydrogen and a selective hydrogenation catalyst to hydrogenate diolefins and carry out a molecular weight-increasing reaction on a portion of the sulphur-containing compounds, said selective hydrogenation being operated at a temperature of 50° C. to 250° C., at a pressure in the range 1 to 5 MPa, with a liquid space velocity of 0.5 to 20 $h^{-1}$ and with a ratio between the flow rate of hydrogen, expressed in normal $m^3$ per hour, and the flow rate of feed to be treated, expressed in $m^3$ per hour under standard conditions, of 2 $Nm^3/m^3$ to 100 $Nm^3/m^3$.

5. The process as claimed in claim 1, in which a) is carried out in two fractionations:

a1) fractionating the gasoline into a light gasoline cut LCN and an intermediate heavy gasoline cut HCN;

a2) fractionating the intermediate heavy gasoline cut HCN into at least one primary intermediate gasoline cut MCN and a primary heavy gasoline cut HHCN.

6. The process as claimed in claim 1, in which a) is carried out in a single fractionation.

7. The process as claimed in claim 6, in which a) is carried out in a divided wall distillation column.

8. The process as claimed in claim 1, in which the primary intermediate gasoline cut MCN obtained from b) has a temperature difference ΔT between the 5% and 95% distilled weight points which is less than 75° C.

9. The process as claimed in claim 8, in which the difference in temperature ΔT between the 5% and 95% distilled weight points is in the range 20° C. to 65° C.

10. The process as claimed in claim 8, in which the secondary intermediate gasoline cut MCN obtained from step d) has the same temperature difference ΔT between the 5% and 95% distilled weight points as that for the primary intermediate gasoline cut MCN.

11. The process as claimed in claim 8, in which the secondary intermediate gasoline cut MCN obtained from d) has a temperature difference ΔT between the 5% and 95% distilled weight points which is less than that for the primary intermediate gasoline cut MCN.

12. The process as claimed in claim 1, in which the hydrodesulphurization catalysts of b) and c) comprise at least one element from group VIII, at least one element from group VIb and a support.

13. The process as claimed in claim 1, in which the secondary intermediate gasoline cut MCN obtained from d) and the desulphurized secondary heavy gasoline cut HHCN obtained from e) are sent to a communal stabilization column.

14. The process as claimed in claim 1, in which the gasoline cut is obtained from a catalytic cracking or thermal cracking unit.

* * * * *